US008139960B2

(12) United States Patent
Okazaki et al.

(10) Patent No.: US 8,139,960 B2
(45) Date of Patent: Mar. 20, 2012

(54) IMAGE-FORMING DEVICE HAVING BELT CLEANING UNIT

(75) Inventors: Yoshiyuki Okazaki, Nagoya (JP); Takeshi Yamanaka, Seto (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 701 days.

(21) Appl. No.: 12/264,736

(22) Filed: Nov. 4, 2008

(65) Prior Publication Data

US 2009/0116853 A1 May 7, 2009

(30) Foreign Application Priority Data

Nov. 7, 2007 (JP) ..... 2007-289827

(51) Int. Cl.
*G03G 15/16* (2006.01)
*G03G 21/00* (2006.01)

(52) U.S. Cl. ..... 399/12; 399/35; 399/101; 399/358; 399/360

(58) Field of Classification Search ..... 399/12, 399/35, 101, 358, 360
See application file for complete search history.

(56) References Cited

U.S. PATENT DOCUMENTS 4,436,414 A * 3/1984 Kamiyama et al. ..... 399/35
4,711,561 A * 12/1987 Tsuruoka ..... 399/35
5,589,915 A * 12/1996 Hashimoto ..... 399/120
7,356,269 B2 * 4/2008 Park ..... 399/35
7,460,799 B2 12/2008 Yamaguchi
7,742,708 B2 * 6/2010 Fukusada ..... 399/12
7,894,730 B2 * 2/2011 Okano et al. ..... 399/35
7,917,078 B2 * 3/2011 Tsusaka et al. ..... 399/360
2004/0190918 A1 * 9/2004 Park ..... 399/35
2006/0193648 A1 * 8/2006 Kadowaki et al. ..... 399/13
2006/0269305 A1 * 11/2006 Murakami et al. ..... 399/35
2007/0071464 A1 3/2007 Yamaguchi
2008/0159760 A1 * 7/2008 Okano et al. ..... 399/35

FOREIGN PATENT DOCUMENTS

JP 2002-139971 5/2002
JP 2002-196644 7/2002
JP 2005-257813 9/2005
JP 2007-93663 A 4/2007

OTHER PUBLICATIONS

Chinese Official Action dated Oct. 8, 2010 together with an English language translation.

* cited by examiner

*Primary Examiner* — David Gray
*Assistant Examiner* — Francis Gray
(74) *Attorney, Agent, or Firm* — Scully, Scott, Murphy & Presser, PC

(57) ABSTRACT

An image-forming device includes an electrophotographic image-forming section, a receptacle, a detecting unit, a shielding member, a drive mechanism. The electrophotographic image-forming section transfers developer onto a recording sheet to form developer image thereon. The receptacle collects developer not transferred onto the recording sheet. The receptacle includes a detection portion. The detecting unit detects light passing through the detection portion. The shielding member is movably disposed in the detection portion to move between a first position blocking the light to be detected by the detecting unit and a second position allowing the light to pass through the detection portion. The drive mechanism moves the shielding member between the first position and the second position in a direction different from a vertical direction.

13 Claims, 12 Drawing Sheets

A–A

IMAGE-FORMING DEVICE HAVING BELT CLEANING UNIT

CROSS REFERENCE TO RELATED APPLICATION

The present application claims priority from Japanese patent application No. 2007-289827 filed Nov. 7, 2007. The entire contents of the priority application are incorporated herein by reference.

TECHNICAL FIELD

The present invention relates to an electrophotographic image-forming device.

BACKGROUND

For example, the image-forming device disclosed in Japanese Patent Application Publication No. 2005-257813 is provided with a receptacle for collecting developer not transferred onto the recording sheet (waste toner). Specifically, this image-forming device supplies a motive force to a screw shaft used to convey waste toner via a slipper clutch, whereby the slipper clutch interrupts the transfer of the motive force to the screw shaft when torque greater than a prescribed amount is applied to the screw shaft. An encoder that rotates together with the screw shaft detects the rotating speed of the screw shaft.

As the amount of waste toner accumulated in the receptacle increases, the rotational force for rotating the screw shaft is increased. When the slipper clutch interrupts the transfer of the motive force, reducing the rotating speed of the screw shaft, it is determined that the amount of toner accumulated in the receptacle has exceeded a prescribed amount, indicating chat the receptacle should be replaced.

SUMMARY

However, since the image-forming device described above employs a disk encoder, the maximum height of the receptacle cannot be made smaller than the diameter of the encoder, making it difficult to reduce the height of the overall image-forming device.

In view of the foregoing, it is an object of the present invention to reduce the maximum height of the receptacle mounted on the image-forming device.

To achieve the above and other objects, one aspect of the invention provides an image-forming device including an electrophotographic image-forming section, a receptacle, a detecting unit, a shielding member, a drive mechanism. The electrophotographic image-forming section transfers developer onto a recording sheet to form developer image thereon. The receptacle collects developer not transferred onto the recording sheet. The receptacle includes a detection portion. The detecting unit detects light passing through the detection portion. The shielding member is movably disposed in the detection portion to move between a first position blocking the light to be detected by the detecting unit and a second position allowing the light to pass through the detection portion. The drive mechanism moves the shielding member between the first position and the second position in a direction different from a vertical direction.

DETAILED DESCRIPTION

The preferred embodiment applies the electrophotographic image-forming device according to the present invention to a laser printer employing toner powder as the developer. The laser printer according to the preferred embodiment will be described next while referring to the accompanying drawings.

First Embodiment

1. Structure of the Image-Forming Device

Figure 1:
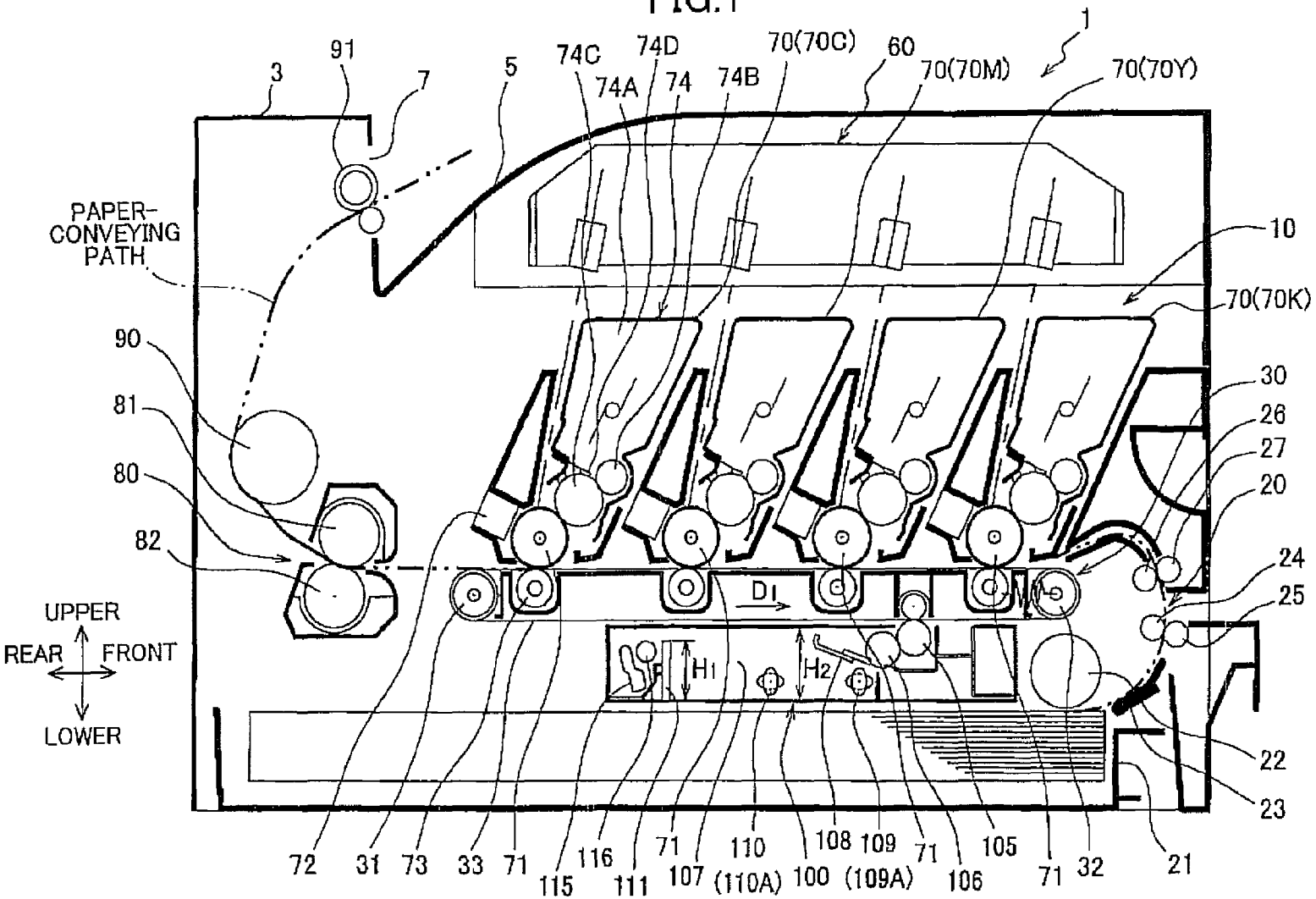
FIG. 1 is a side cross-sectional view showing the principle structure of an image-forming device according to a first embodiment of the present invention.

In FIG. 1, an image-forming device 1 is oriented such that the top is the direction from which the force of gravity is applied, while the right side of the image-forming device 1 will be referred to as the "front." The image-forming device 1 has a substantially box-shaped (solid rectangular shaped) casing 3. A discharge tray 5 is provided on the top surface of the casing 3 for receiving and holding sheets of paper, transparencies, or the like (hereinafter simply referred to as paper) discharged from the casing 3 after printing.

In this embodiment, frame members (not shown) formed of metal, synthetic resin, or the like are provided on the inside of the casing 3. Toner cartridges 70, a fixing unit 80, and the like described later are detachably mounted on the frame members.

The image-forming device 1 also includes an image-forming unit (electrophotographic image-forming section) 10 for forming images on the paper, a feeding unit 20 for supplying paper to the image-forming unit 10, and a conveying mechanism 30 for conveying paper to four toner cartridges 70K, 70Y, 70M, and 70C constituting the image-forming unit 10.

The image-forming device 1 further includes an intermediate conveying roller 90 disposed downstream of the fixing unit 80, a discharge chute (not shown) for guiding the paper upward and back coward the front, so that the paper is inverted substantially 180 degrees, and a discharge roller 91 for discharging the paper from the casing 3 via a discharge opening 7 After images have been formed on a sheet of paper in the image-forming unit 10, the intermediate conveying roller 90 receives and conveys the sheet along the discharge chute to the discharge roller 91, and the discharge roller 91 discharges the paper through the discharge opening 7 onto the discharge tray 5.

1.1. Feeding Unit

The feeding unit 20 includes a paper tray 21 accommodated in the bottommost section of the casing 3, a feeding roller 22 disposed above the front end of the paper tray 21 for feeding (conveying) sheets of paper from the paper tray 21 to the image-forming unit 10, and a separating pad 23 for separating the sheets of paper supplied by the 20 feeding roller 22 by applying a prescribed resistance to the paper so that one sheet is fed at a time.

A U-shaped conveying path is provided in the front end of the casing 3 for guiding sheets of paper fed by the feeding roller 22 from the paper tray 21 toward the image-forming unit 10 provided substantially in the center of the casing 3. A conveying roller 24 is disposed along this substantially U-shaped conveying path leading from the paper tray 21 to the image-forming unit 10 for applying a force to the sheet to convey the sheet to the image-forming unit 10 as the sheet follows the U-shaped path.

A pinch roller 25 is disposed at a position opposing the conveying roller 24 along the conveying path for pressing the sheet or paper against the conveying roller 24. Coil springs (not shown) or other urging means urge the pinch roller 25 toward the conveying roller 24.

A registration roller 26 and a pinch roller 27 disposed in opposition to the registration roller 26 are provided downstream of the conveying roller 24 in the paper-conveying direction for conveying the sheet of paper toward the image-forming unit 10 after first correcting skew in the paper as the leading edge of the paper conveyed by the conveying roller 24 contacts the rollers. Coil springs (not shown) or other urging means urge the pinch roller 27 toward the registration roller 26.

1.2. Conveying Mechanism

The conveying mechanism 30 includes a drive roller 31 that is rotated in association with the operations of the image-forming unit 10, a follow roller 32 rotatably disposed at a position separated from the drive roller 31, and a conveying belt 33 wound around the drive roller 31 and follow roller 32.

When a sheet of paper is conveyed from the paper tray 21 onto the conveying belt 33, the circulating conveying belt 33 sequentially conveys the sheet to each of the four toner cartridges 70K, 70Y, 70M, and 70C.

A belt cleaner 100 is disposed beneath the conveying belt 33 for removing toner deposited on the surface thereof. The belt cleaner 100 will be described in greater detail below.

1.3. Image-Forming Unit

The image-forming unit 10 includes a scanning unit 60, the toner cartridges 70, and the fixing unit 80. The image-forming unit 10 according to this embodiment is a direct tandem-type unit capable of printing color images.

In this embodiment, the four toner cartridges 70K, 70Y, 70M, and 70C are arranged in a series along the paper-conveying direction and correspond to the four toner colors black, yellow, magenta, and cyan in order from the upstream side of the paper-conveying direction.

1.3.1. Scanning Unit

The scanning unit 60 is an exposure device disposed in the upper section of the casing 3 for forming electrostatic latent images on the surfaces of photosensitive drums 71 provided in each of the toner cartridges 70K, 70Y, 70M, and 70C. Specifically, the scanning unit 60 includes laser light sources, a polygon mirror, fθ lenses, and reflecting mirrors.

Each laser light source emits a laser beam based on image data. The laser beam is deflected off the polygon mirror through an fθ lens. Subsequently, a reflecting mirror bends the optical path of the laser beam, and another reflecting mirror bends the optical path again to a downward direction so that the bean is irradiated on the surface of the corresponding photosensitive drum 71, forming an electrostatic latent image thereon.

1.3.2. Toner Cartridges

Since the toner cartridges 70K, 70Y, 70M, and 70C all have the same structure, differing only in the color of toner accommodated therein, only the structure of the cyan toner cartridge 70C will be described below. Further, in the following description, the toner cartridges 70K, 70Y, 70M, and 70C will be referred to collectively as the toner cartridges 70.

The toner cartridges 70 are detachably mounted in the casing 3 below the scanning unit 60. Each toner cartridge 70 includes the photosensitive drum 71, a charger 72, and a toner-accomodating unit 74.

Each photosensitive drum 71 functions to carry an image to be transferred onto the paper. The photosensitive drum 71 is a cylindrical member, the outer surface of which is coated with a positive-charging photosensitive layer formed of polycarbonate or the like.

Each charger 72 functions to charge the surface of the corresponding photosensitive drum 71. The charger 72 is disposed diagonally above and rearward of the corresponding photosensitive drum 71, opposing the photosensitive drum 71, but is separated a prescribed distance therefrom.

The charger 72 according to this embodiment is a Scorotron charger having a charging wire formed of tungsten or the like for producing a corona discharge and functions to charge the surface of the photosensitive drum 71 with a uniform positive polarity.

Transfer rollers 73 are disposed on the opposite side of the conveying belt 33 from the photosensitive drums 71 and are rotatably supported in frame members (not shown) of the conveying mechanism 30. The transfer rollers 73 rotate along with the circular movement of the conveying belt 33.

The transfer rollers 73 function to transfer toner images carried on the photosensitive drums 71 onto a sheet of paper as the paper passes each of the photosensitive drums 71. The transfer rollers 73 apply a charge of opposite polarity to the charge of the photosensitive drums 71 to the side of the paper opposite the printing surface, causing the toner deposited on the surfaces of the photosensitive drums 71 to be transferred onto the printing surface.

The toner-accommodating unit 74 has a toner-accommodating chamber 74A for accommodating toner, a supply roller 74B and a developing roller 74C for supplying toner to the corresponding photosensitive drum 71, and a thickness-regulating blade 74D for regulating the thickness of toner carried on the surface of the photosensitive drum 71.

With this construction, the supply roller 74B rotates to supply toner accommodated in the toner-accommodating chamber 74A onto the developing roller 74C. The toner carried on the surface of the developing roller 74C is regulated to a prescribed uniform thickness by the thickness-regulating blade 74D. Subsequently, the layer of toner carried by the developing roller 74C is supplied to areas on the surface of the photosensitive drum 71 that were exposed by the scanning unit 60.

1.3.3. Fixing Unit

The fixing unit 80 is detachably mounted in the frame members of the casing 3 described earlier at a position downstream of the photosensitive drums 71 with respect to the paper-conveying direction. The fixing unit 80 functions to fix the toner transferred onto the paper with heat.

The fixing unit 80 includes a heating roller 81 disposed on the printing surface side of the paper that applies a conveying force to the paper while heating the toner, and a pressure roller 82 disposed on the opposite side of the paper in opposition to the heating roller 81 for pressing the paper against the heating roller 81.

2. Detailed Description of the Belt Cleaner

Figure 2:
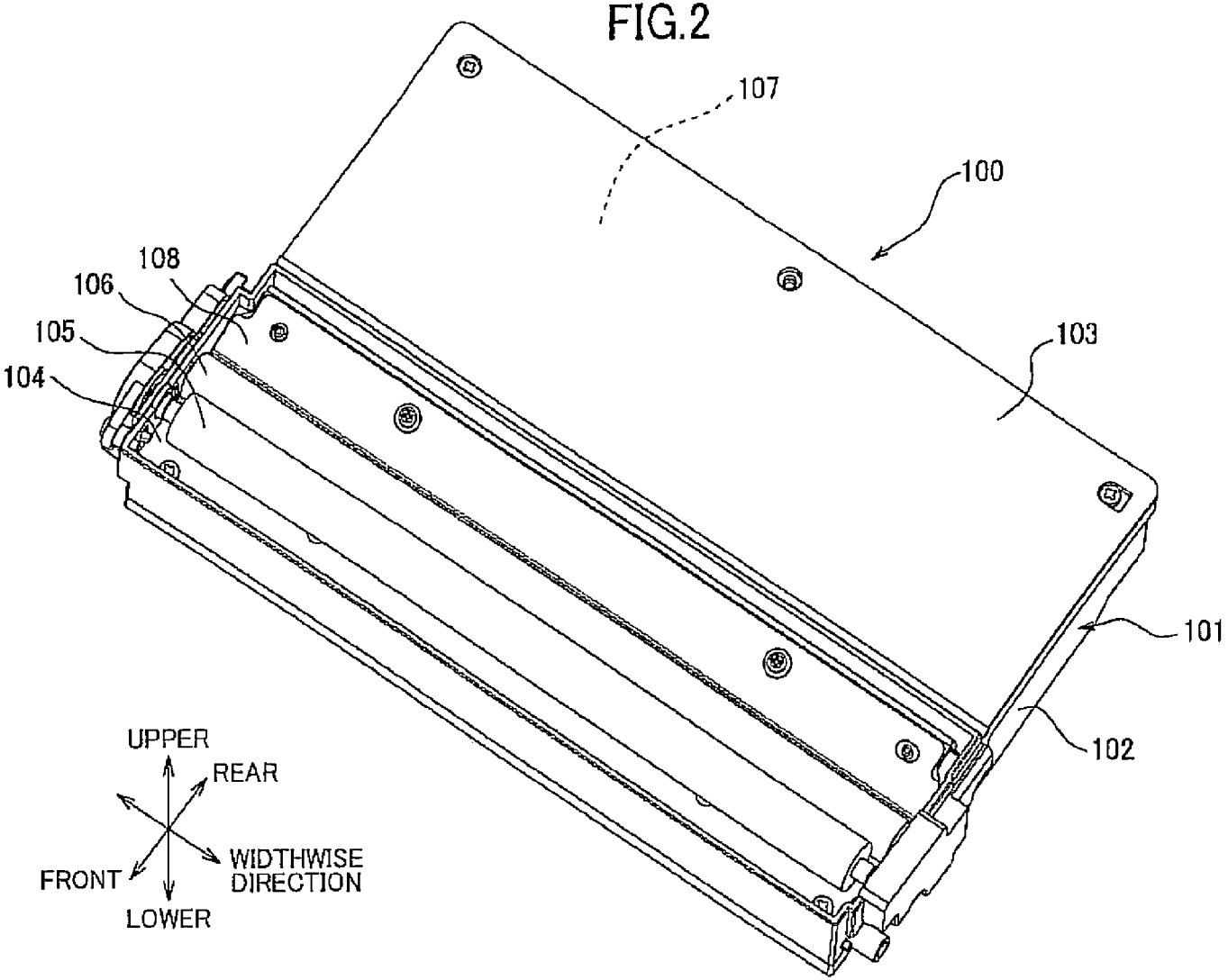
FIG. 2 is a perspective view showing the top of a belt cleaner according to the first embodiment.
Figure 3:
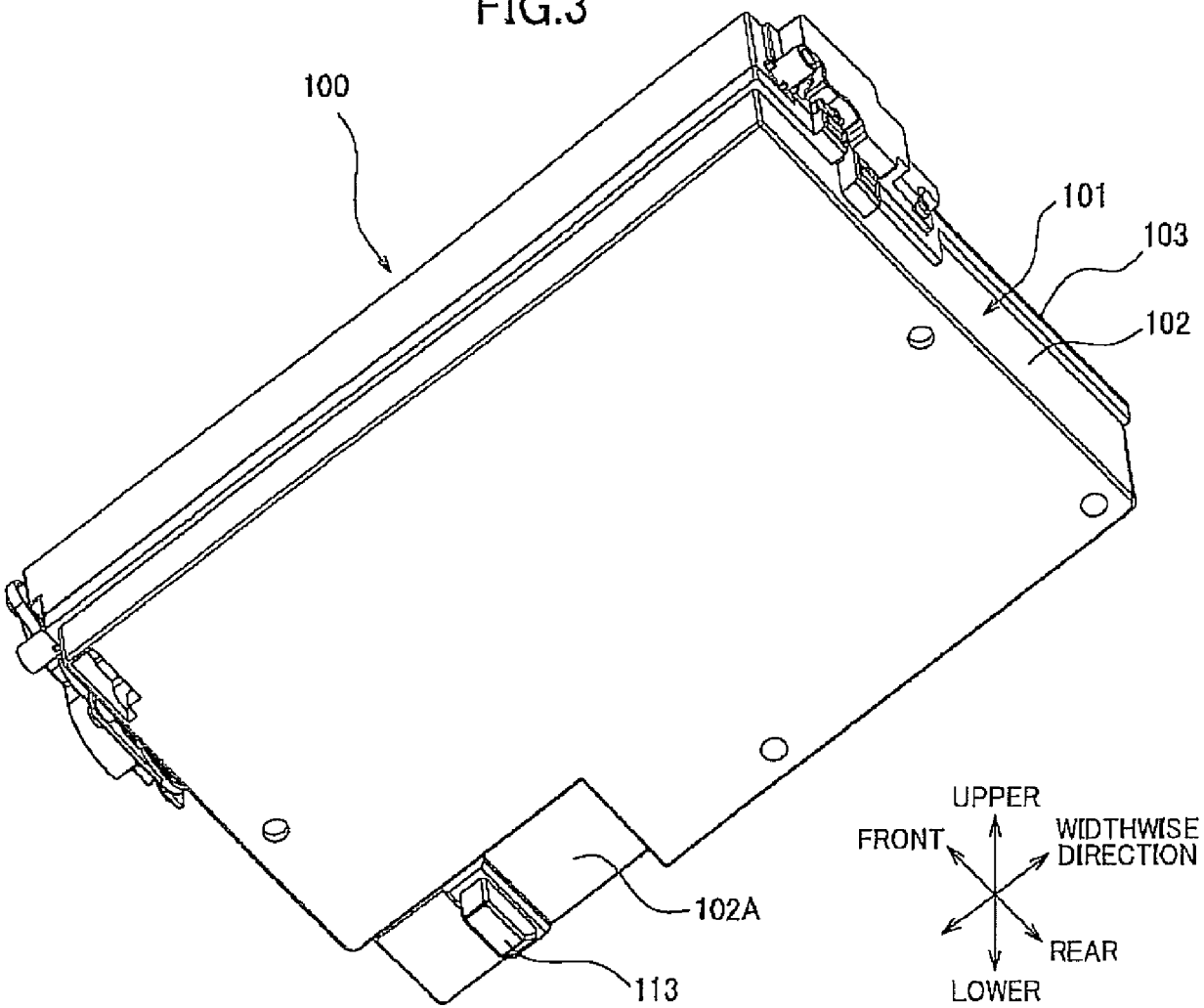
FIG. 3 is a perspective view showing the bottom of the belt cleaner.

As shown in FIGS. 2 and 3, the belt cleaner 100 is detachably mounted as a modular unit in the frame members constituting the body of the image-forming device 1.

The belt cleaner 100 includes a receptacle 101 for collecting toner not transferred onto the paper. The receptacle 101 includes a receptacle body 102 and a top cover 103 covering the top of the receptacle body 102. The top cover 103 is detachably attached to the receptacle body 102 by screws or another fastening means.

An intake opening 104 is provided in the top surface of the receptacle 101 (top cover 103) at the front end thereof for introducing toner removed from the conveying belt 33 into the receptacle 101.

A cleaning roller 105 is disposed in the intake opening 104 for removing toner deposited on the surface of the conveying belt 33. A cleaning shaft 106 conveys toner deposited on the surface of the cleaning roller 105 to a waste-toner-accumulating section (toner accumulating portion) 107 (see FIG. 1).

In this embodiment, the cleaning roller 105 contacts the conveying belt 33 while rotating in a direction (counterclockwise direction) opposite the circulating direction of the conveying belt 33 (indicated by D1 in FIG. 1). In this way, the cleaning roller 105 can scrape off toner deposited on the conveying belt 33.

The cleaning shaft 106 rotates in contact with the outer surface of the cleaning roller 105. Further, since the cleaning shaft 106 is charged with a polarity (negative charge) opposite the polarity carried by the toner, the toner carried on the surface of the cleaning roller 105 is transferred to the cleaning shaft 106, thereby removing waste toner from the cleaning roller 105.

As shown in FIG. 1, a thin plate-shaped blade 108 contacts the surface of the cleaning shaft 106 for scraping off the waste toner transferred to this surface, allowing the toner to fall into the waste-toner-accumulating section 107.

The waste-toner-accumulating section 107 is configured of a space for accommodating waste toner and is formed the receptacle body 102 and the top cover 103. First and second toner-conveying pump mechanisms (toner conveying mechanisms) 109 and 110 are disposed in the waste-toner-accumulating section 107 for conveying the waste toner toward the back (rear side) of the waste-toner-accumulating section 107, while compacting the waste toner accommodated therein.

The first and second toner-conveying pump mechanisms 109 and 110 have respective elliptical rotors 109A and 110A that are elliptically shaped in a cross section taken orthogonal to their rotational axes. The elliptical rotors 109A and 110A extend in a direction parallel to the axial direction of the cleaning roller 105 (hereinafter referred to as the widthwise direction) and convey waste toner toward the rear of the waste-toner-accumulating section 107.

Figure 4:
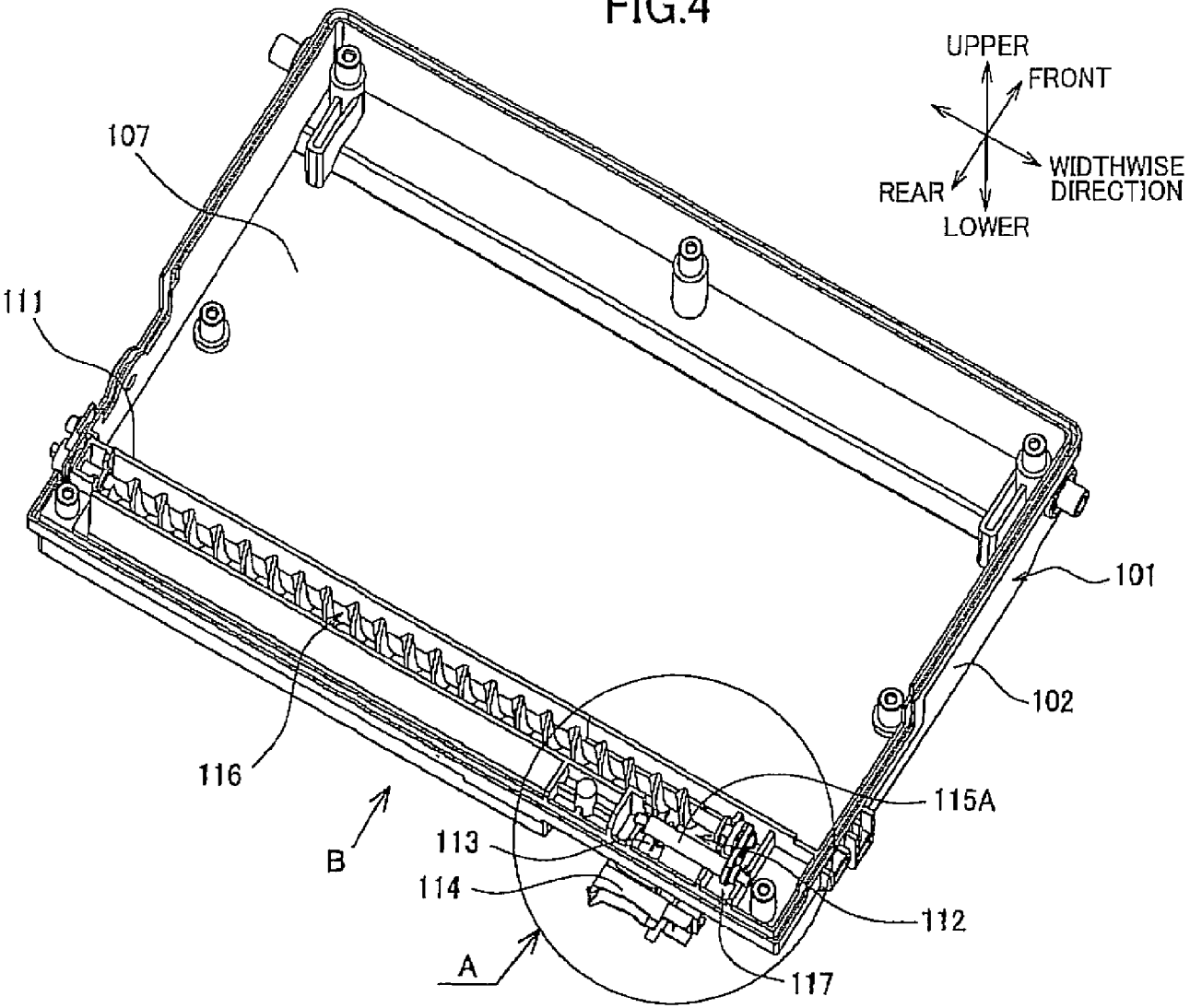
FIG. 4 is a perspective view showing the top of the belt cleaner when a cover has been removed.

As shown in FIG. 4, a wall 111 extends across substantially the entire width of the waste-toner-accumulating section 107 near the rear side of the receptacle 101, which is the downstream end in the direction that the first and second toner-conveying pump mechanisms 109 and 110 convey waste toner. The wall 111 functions as a dam for blocking waste toner conveyed by the first and second toner-conveying pump mechanisms 109 and 110 from moving further rearward.

Figure 7:
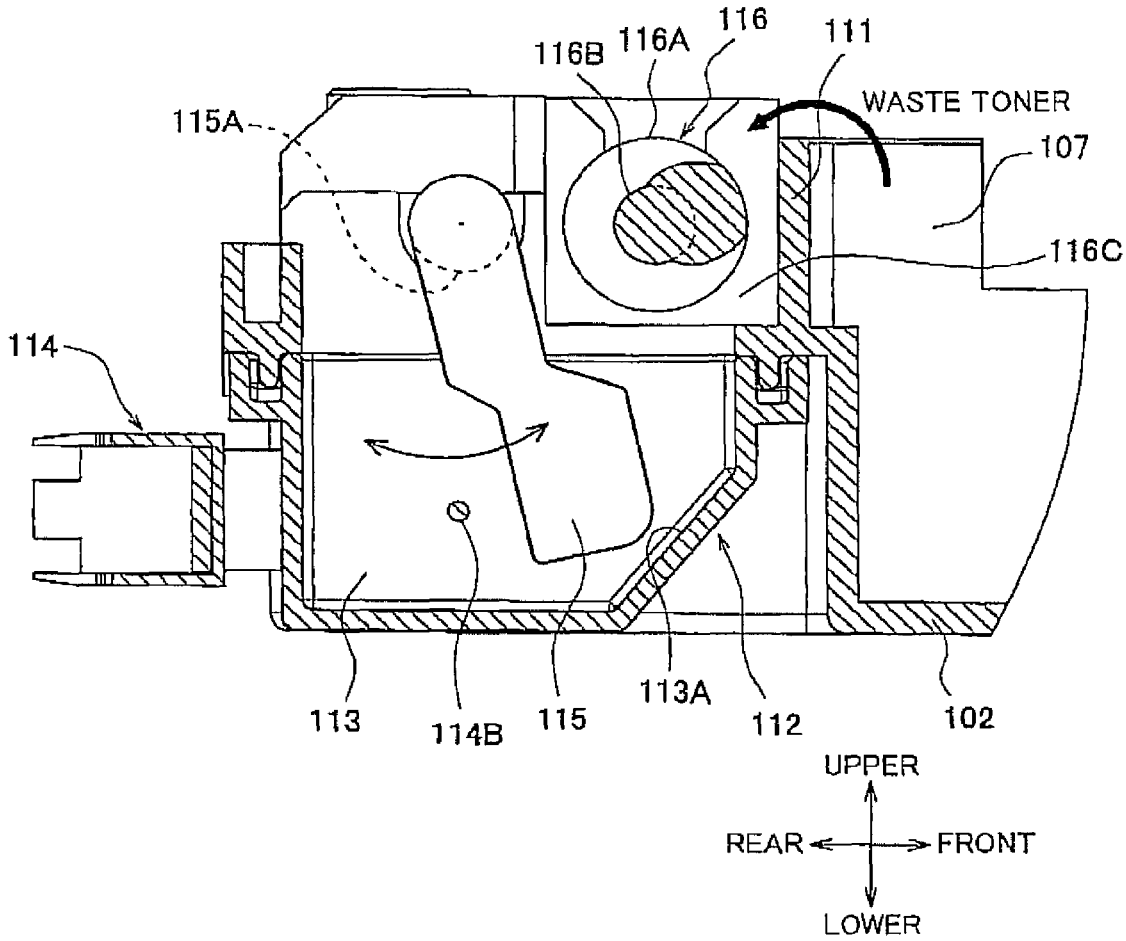
FIG. 7 is a cross-sectional view of the belt cleaner along the plane VII-VII in FIG. 6.

As shown in FIG. 1, the wall 111 has a height H1 set lower than a height H2 of the waste-toner-accumulating section 107. The height H2 is a distance between the bottom wall of the receptacle body 102 and the top cover 103. Hence, when the waste toner accumulated in the waste-toner-accumulating section 107 increases, the waste toner flows over the wall 111, as indicated in FIG. 7, and flows into a waste-toner-detecting section 112 provided on the other side of the wall 111 from the waste-toner-accumulating section 107.

As shown in FIG. 4, a detection portion 113 is provided on one end of the waste-toner-detecting section 112 in the widthwise direction. The detection portion 113 forms a detection space 113*a*. Waste toner that flows over the wall 111 into the waste-toner-detecting section 112 accumulates in the detection space 113*a*. As shown in FIG. 3, a recessed part 102A is provided in the receptacle body 102, and the detection portion 113 protrudes downward from the recessed part 102A.

As shown in FIG. 4, a photosensor (detecting unit) 114 is fixedly attached to the casing 3 of the image-forming device 1 at a position opposing the detection space 113*a* formed by the detection portion. The photosensor 114 emits a beam of light into the detection space 113*a* and receives the light exiting from the detection space 113*a*.

Figure 8:
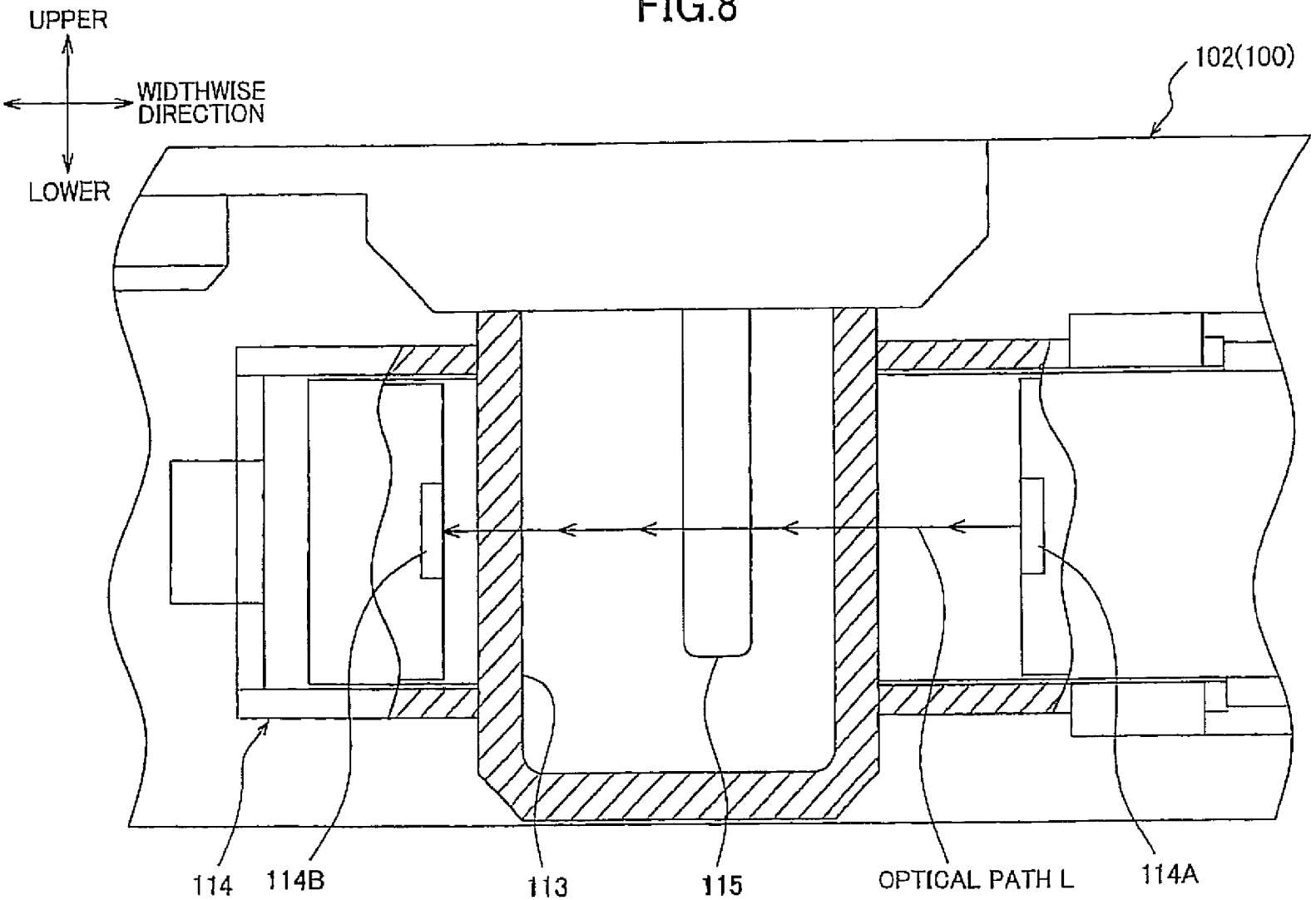
FIG. 8 is an enlarged cross-sectional view of a region B in FIG. 6.

More specifically, the photosensor 114 has a light-emitting unit 114A positioned on one side of the detection space 113*a* in the widthwise direction, and a light-receiving unit 114B positioned on the other side when the belt cleaner 100 is mounted in the casing 3 (frame members), as shown in FIG. 8. Therefore, the detection space 113*a* (detection portion 113) is interposed between the light-emitting unit 114A and the light-receiving unit 114B while the belt cleaner 100 is mounted in the casing 3.

Normally, it would be necessary to provide light-transmissible windows in the detection portion 113 constituting the detection space 113*a* at regions corresponding no a light path L of the light emitted from, the light-emitting unit 114A. However, the detection portion 113 in this embodiment is constructed entirely of transparent members formed of an acrylic or the like, allowing the transmission of light.

In addition, a shielding member 115 is provided in the detection space 113*a* and is capable of being displaced between a first position blocking the light path L and a second position not blocking the light path L. The shielding member 114 is moved in a direction different from the vertical direction. In this embodiment, as shown in FIG. 7, the shielding member 115 is periodically pivoted in a substantially horizontal direction (front-to-rear direction in this embodiment) about a pivoting shaft 115A disposed on the upper end of the shielding member 115. The upper end of the shielding member 115 is fixed to the pivoting shaft 115A.

An auger 116 is provided in the waste-toner-detecting section 112 near the wall 111 for conveying waste toner flowing into the waste-toner-detecting section 112 toward the detection space 113*a*. Specifically, the auger 116 conveys waste toner flowing from regions other than the end in which the detection space 113*a* is provided into the waste-toner-detecting section 112 toward the detection space 113*a*.

Figure 5:
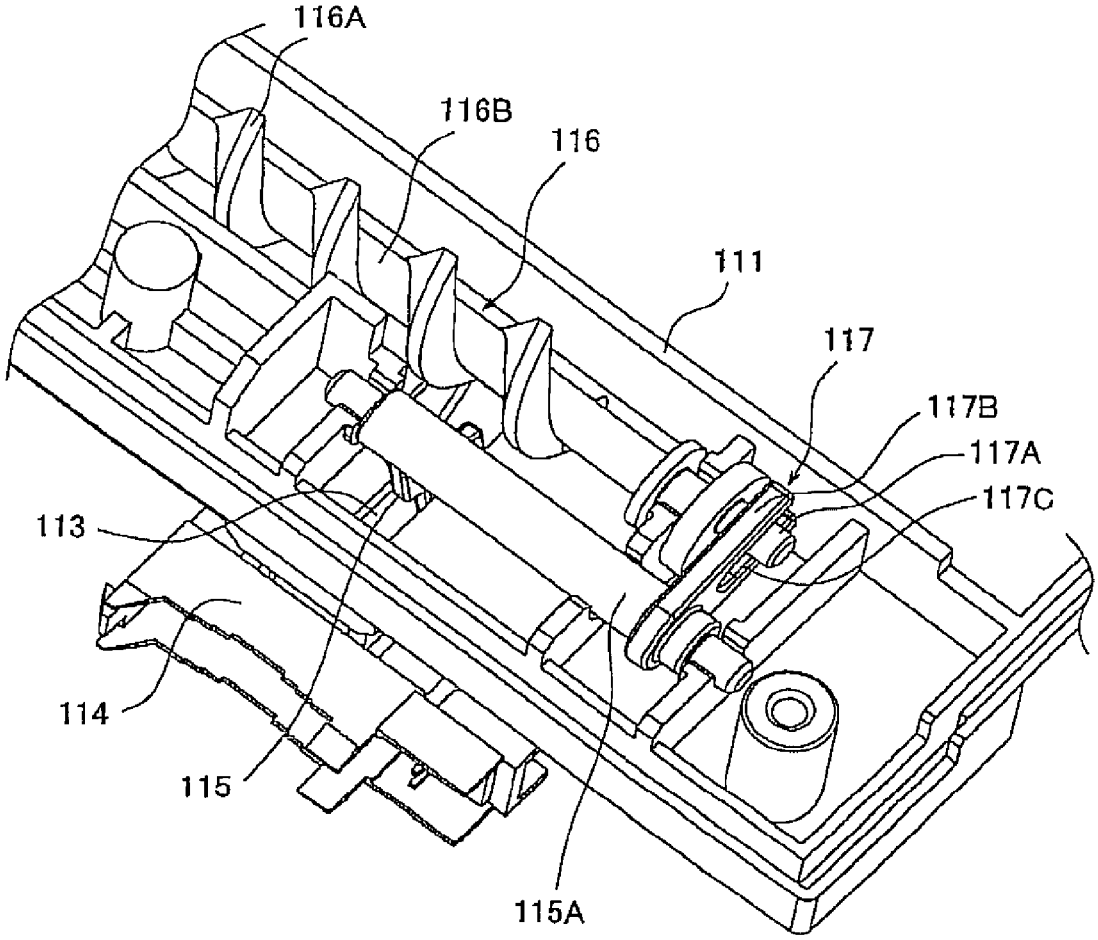
FIG. 5 is an enlarged view of a region A in FIG. 4.
Figure 6:
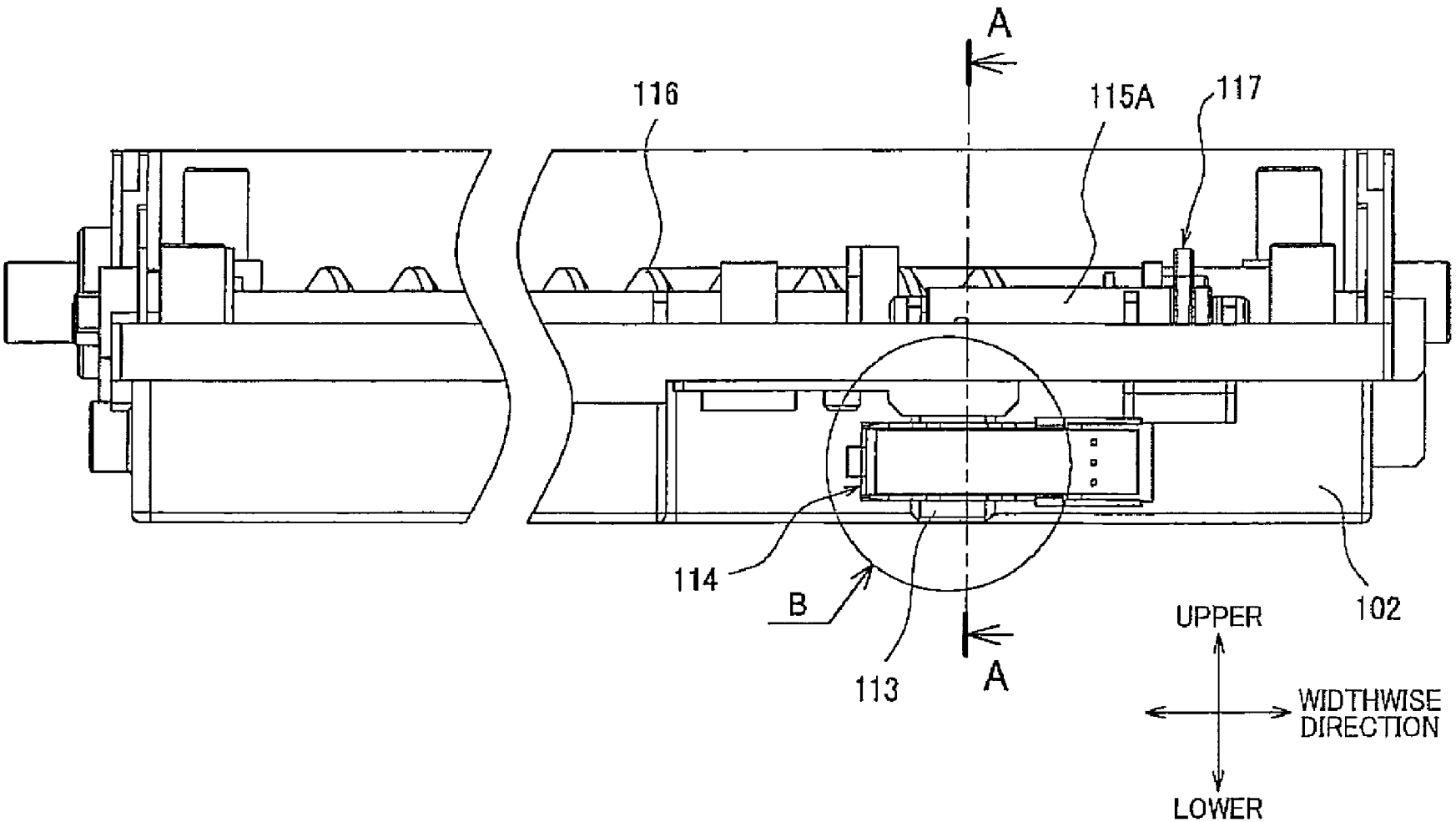
FIG. 6 is a rear view or the belt cleaner from the side indicated by an arrow B in FIG. 4.

The auger 116 is a screw-type powder-conveying pump configured of a screw. As shown in FIG. 5, the screw portion of the auger 116 is configured of a spiral-shaped blade 116A provided around a rotational shaft 116B, and a discharge opening 116C through which toner conveyed by the blade 116A is discharged.

As shown in FIG. 7, the detection portion 113 includes a sloped guiding surface 113A for guiding waste toner conveyed by the auger 116 toward the light path L, i e., toward the region in the detection space 113*a* between the light-emitting unit 114A and light-receiving unit 114B. The sloped guiding surface 113A is sloped relative to the vertical and positioned on the bottom of the detection space 113*a* in an area opposing the discharge opening 116C of the auger 116.

Figure 9:
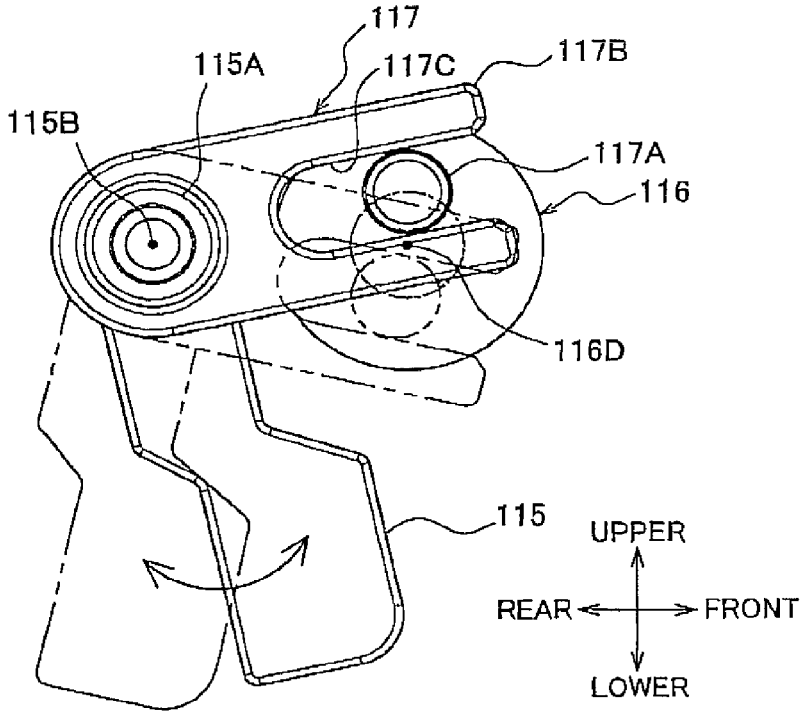
FIG. 9 is a side view of a mechanism for driving a shielding member according to the first embodiment.

As shown in FIG. 9, a pivoting center 115B of the pivoting shaft 115A is offset horizontally from a rotational center 116D of the auger 116 (rotational shaft 116B). The pivoting shaft 115A is also coupled to the rotational shaft 116B (auger 116) via a linkage 117 for converting the rotational motion of the rotational shaft 116B to a pivoting motion. Hence, when the auger 116 (rotational shaft 116B) rotates, the shielding member 115 is moved pivotably displaced horizontally at periods proportionate to the rotational speed.

The linkage 117 is a drive mechanism including a crank pin 117A disposed at an eccentric position to the rotational center 116D of the rotational shaft 116B, and a linking lever 117B with one end fixed to the pivoting shaft 115A. A U-shaped cam groove 117C is formed in the other end of the linking lever 117B for slidably contacting the outer peripheral surface of the crank pin 117A.

Since the belt cleaner 100 has no electric motor or other driving means in this embodiment, a drive force must be obtained from the main structure of the image-forming device 1 to rotate the auger 116, cleaning roller 105, and first and second toner-conveying pump mechanisms 109 and 110. In this embodiment, these components are rotated mechanically in association with the rotation of the conveying belt 33.

3. Electrical Structure of the Image-Forming Device

Figure 10:
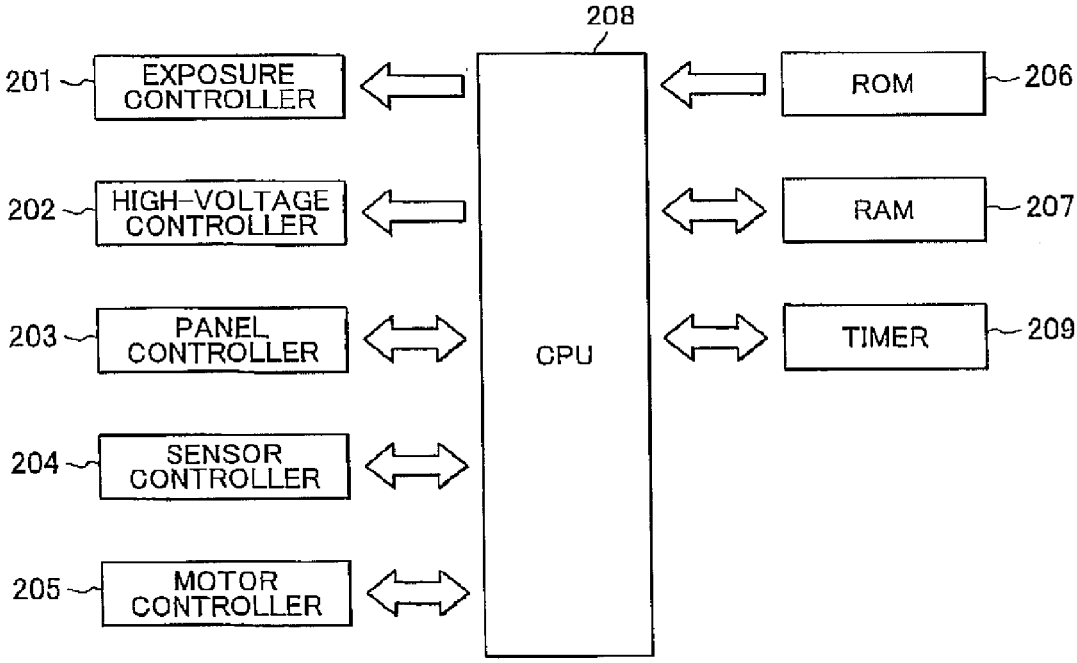
FIG. 10 is a block diagram showing a control system in the image-forming device of the first embodiment.

As shown in FIG. 10, the control system of the image-forming device 1 includes an exposure controller 201 for controlling operations of the scanning unit 60; a high-voltage controller 202 for controlling high voltages used in operations of the toner cartridges 70, e g., high voltages used in operations for developing toner on the photosensitive drum 71 and for transferring toner onto the paper; a panel controller 203 for controlling a control panel (not shown) by which the user inputs settings and operations; a sensor controller 204 fox controlling the light-emitting unit 114A and light-receiving unit 114B of the photosensor 114 and the like; and a motor controller 205 for controlling an electric motor provided in the image-forming device 1 as the drive source.

The control system is also provided with a ROM 206 and a RAM 207 for storing data. More specifically, the RON 206 is a read-only storage device capable of preserving stored data, even when the power supply is interrupted. The RAM 207 is a read/write storage device capable of storing data only when receiving a power supply.

The control system also includes a CPU (determining unit) 208 that performs computations based on programs stored on the ROM 206 for controlling the exposure controller 201 and other controllers; and a timer 209 for keeping track of time and outputting signals indicating this time.

Figure 11:
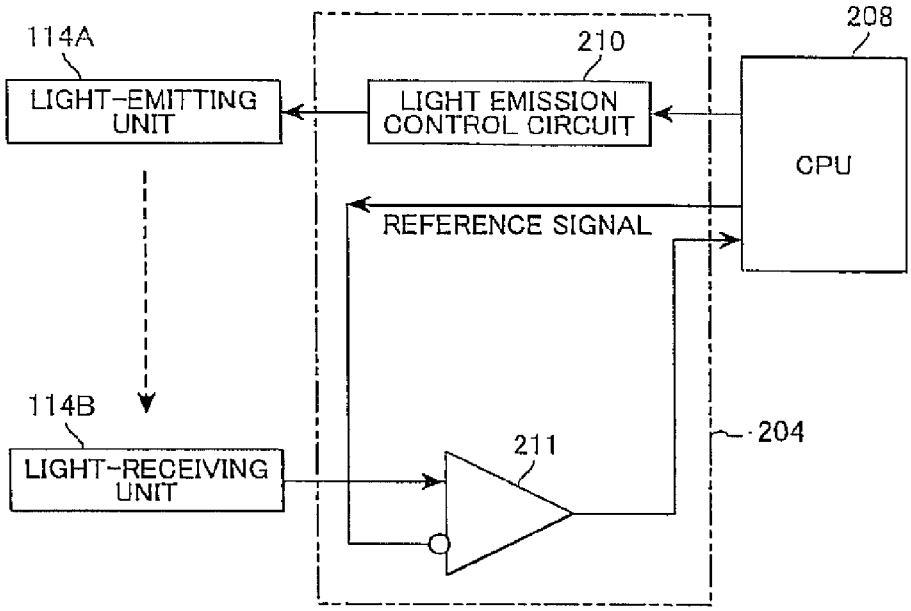
FIG. 11 is a block diagram showing the principle components of a sensor controller according to the first embodiment.

As shown in FIG. 11, the sensor controller 204 includes a light emission control circuit 210 for controlling operations of the light-emitting unit 114A, and a comparator 211 for determining whether the signal level outputted by the light-receiving unit 114B exceeds a reference level when the light-receiving unit 114B receives light and for outputting a LOW signal to the CPU 208 when the signal level exceeds this reference level and a HIGH signal when the signal level does not exceed this reference level.

Figure 12:
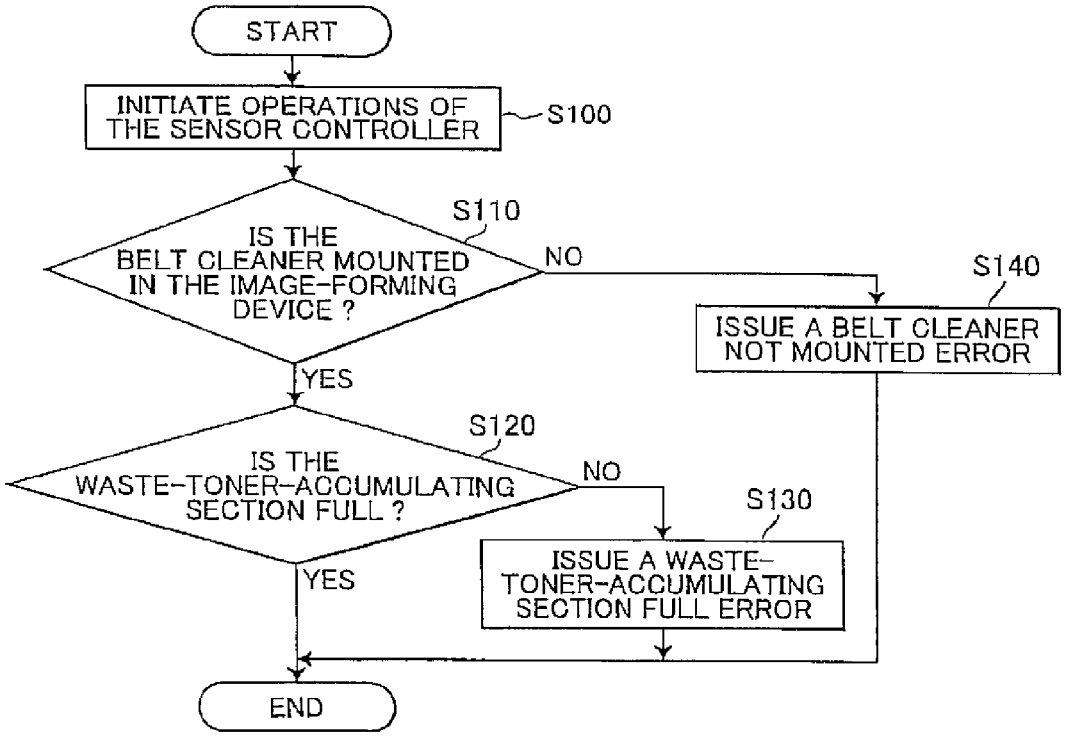
FIG. 12 is a flowchart illustrating steps in a process for controlling the shielding member according to the first embodiment.

4. Control Operations Related to the Photosensor 4.1. Steps in the Control Process When the power switch (not shown) of the image-forming device 1 is turned on, the image-forming device 1 begins a warm-up operation. During this operation, the image-forming device 1 begins to rotate the conveying belt 33 and the auger 116, at which time the CPU 208 executes the control process shown in FIG. 12. This control process is referred to in the following description as a toner detection process.

At the beginning of the toner detection process in S100, the CPU 208 activates the sensor controller 204. In S110 the CPU 208 determines based on output from the sensor controller 204 whether the belt cleaner 100 is mounted in the casing 3. The method of determining whether the belt cleaner 100 is mounted in the casing 3 will be described later in greater detail.

If the CPU 208 determines at this time that the belt cleaner 100 is mounted in the casing 3 (S110: YES), then in S120 the CPU 208 determines based on output from the sensor controller 204 whether the waste-toner-accumulating section 107 can still accumulate toner. In other words, the CPU 208 determines whether the amount of waste toner accumulated in the waste-toner-accumulating section 107 has exceeded a predetermined amount. The method of determining whether the waste-toner-accumulating section 107 can still accumulate toner will be described later in greater detail.

If the CPU 208 determines that the waste-toner-accumulating section 107 can still accumulate toner (S120: YES), then the CPU 208 ends the current control process. However, if the CPU 208 determines that the waste-toner-accumulating section 107 can no longer accumulate toner (S120: YES), then in S130 the CPU 208 issues a warning indicating this situation, and subsequently ends the current control process. In this embodiment, the CPU 208 displays a warning (error) message on a display section of the control panel (not shown) in the process of S130.

Further, if the CPU 208 determines in S110 that the belt cleaner 100 is not mounted in the casing 3 (S110: NO), then in S140 the CPU 208 issues a warning indicating that the belt cleaner 100 is not mounted in the casing 3, and subsequently ends the control process. In this embodiment, the CPU 208 displays a warning (error) message on the display section of the control panel (not shown) in the process of S140.

4.2. Determining When the Belt Cleaner is Mounted and Determining the Toner Level Since the shielding member 115 periodically pivots about the pivoting shaft 115A, the light path L is periodically blocked by the shielding member 115 when the belt cleaner 100 is mounted in the casing 3 and toner has not accumulated in the detection space 113*a*.

Figure 13:
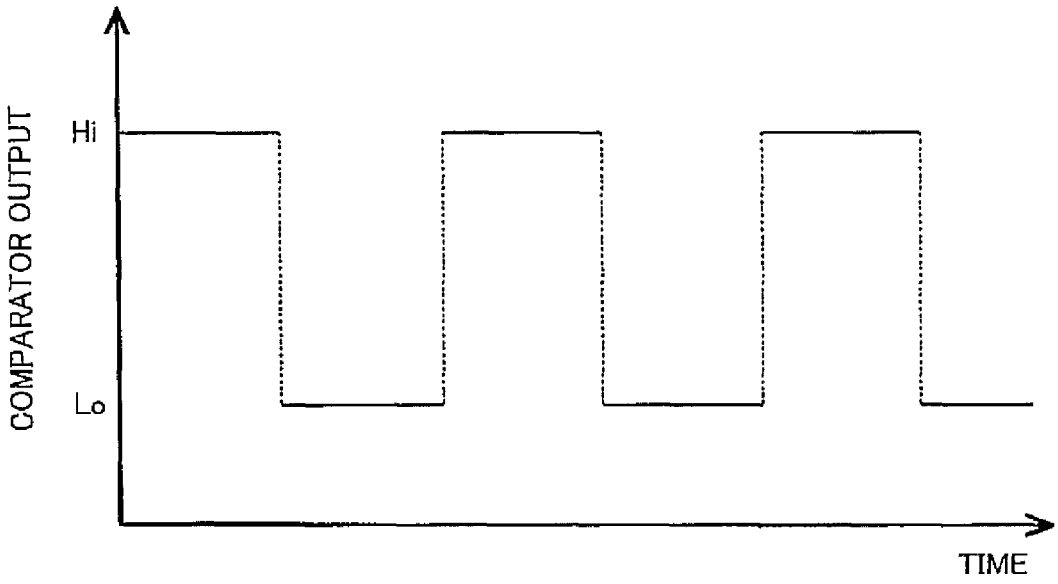
FIG. 13 is a graph showing the signal outputted from the sensor controller over time when toner has not accumulated in a detection space.

Hence, when the belt cleaner 100 is mounted in the casing 3 and toner has not accumulated in the detection space 113*a*, the comparator 211 outputs a signal that periodically alternates between a HIGH signal and a LOW signal, as indicated in FIG. 13.

Figure 14:
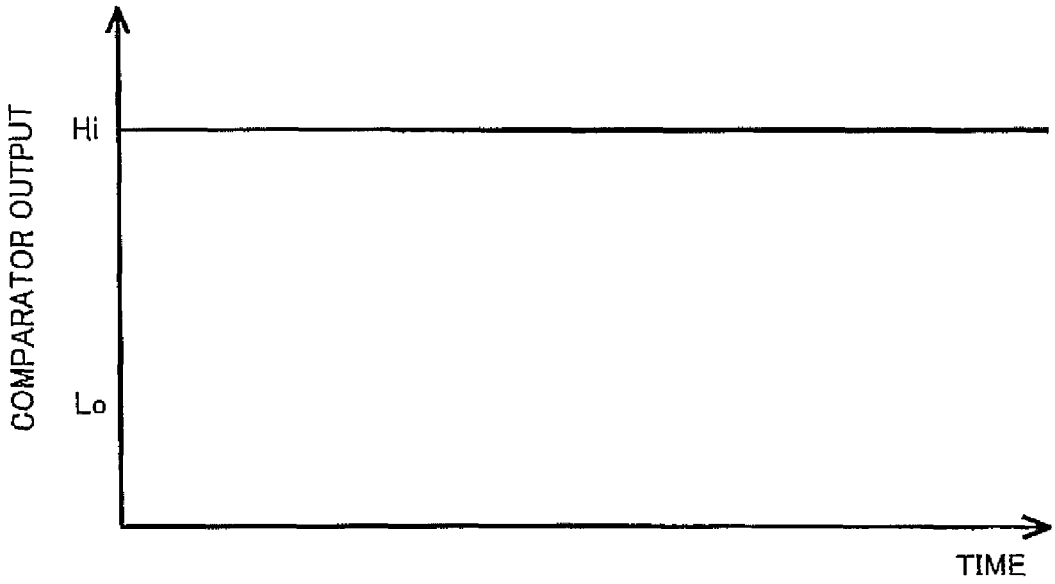
FIG. 14 is a graph showing the signal outputted from the sensor controller over time when toner has accumulated in the detection space.

If the belt cleaner 100 is mounted in the casing 3 but toner has accumulated in the detection space 113*a*, then the light path L is continuously blocked by the Loner. Therefore, the comparator 211 continuously outputs a HIGH signal, as indicated in FIG. 14.

Figure 15:
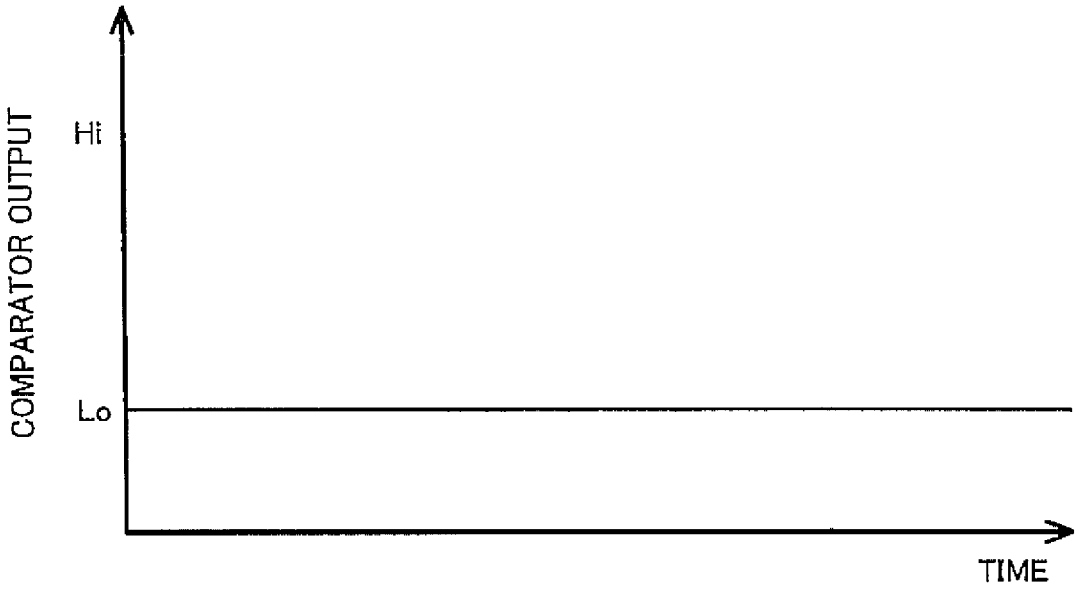
FIG. 15 is a graph showing the signal outputted from the sensor controller over time when the belt cleaner is not mounted in the image-forming device.

Further, since the photosensor 114 is mounted in the casing 3, if the belt cleaner 100 is not mounted in the casing 3, the light path L is continuously not blocked. Therefore, the comparator 211 continuously outputs a LOW signal, as indicated in FIG. 15.

Accordingly, in this embodiment, the CPU 208 determines that the belt cleaner 100 is mounted in the casing 3 and that the waste-toner-accumulating section 107 is capable of further accumulating toner when light is periodically detected (FIG. 13), determines that the waste-toner-accumulating section 107 can no longer accumulate toner (S120: NO of FIG. 12) when the light is not periodically detected (FIG. 14), and determines that the belt cleaner 100 is not mounted in the casing 3 when the light is continuously detected (FIG. 15).

However, if the shielding member 115 cannot pivot due to a failure of the auger 116, pivoting shaft 115A, or shielding member 115, the comparator 211 continuously outputs either a high signal or a low signal. Accordingly, the image-forming device 1 of this embodiment cannot distinguish between a case in which one of the above components has failed and a case in which either the waste-toner-accumulating section 107 can no longer accumulate toner or the belt cleaner 100 is not mounted in the casing 3.

However, it is necessary to issue some kind of warning in either case since the image-forming device 1 cannot continue to operate. Therefore, the image-forming device 1 of this embodiment alerts the user by issuing a warning message, as described above, whenever the light is not periodically detected.

5. Features of the Image-Forming Device According to this Embodiment

In this embodiment, the shielding member 115 is periodically reciprocated in a horizontal direction between a position blocking the light path L of light detected by the light-receiving unit 114B and a position not blocking the light path L. Therefore, it is not necessary to allocate space in the vertical direction, i.e., the height direction for moving the shielding member 115.

Thus, the maximum height dimension of the belt cleaner 100 can be reduced, thereby reducing the height dimension of the image-forming device 1.

Further, in this embodiment described above, the detection space 113*a* is formed by the sloped guiding surface 113A for guiding toner conveyed into the detection space 113*a* toward the light path L, thereby ensuring that toner conveyed into the detection space 113*a* is reliably detected.

Second Embodiment

In the first embodiment described above, the shielding member 115 is pivoted. However, in a second embodiment, a shielding member 215 is reciprocated in a direction parallel to the horizontal, as shown in FIG. 16.

Figure 16:
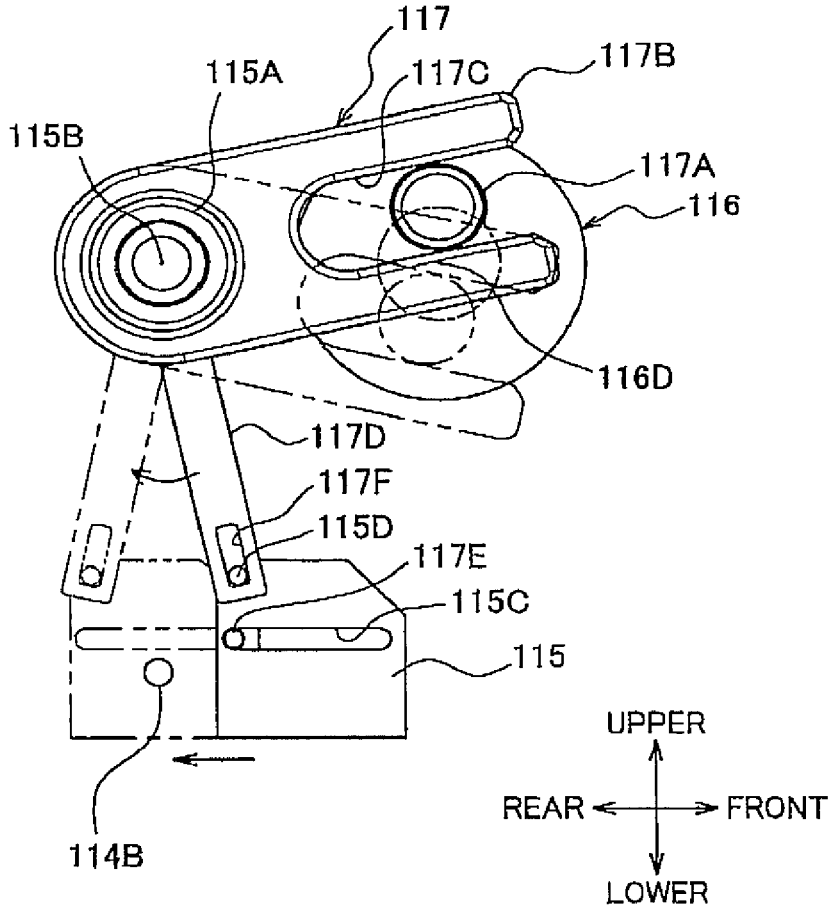
FIG. 16 is a side view of a mechanism for driving the shielding member according to a second embodiment.

More specifically, as shown in FIG. 16, a lever 117D fixed to the pivoting shaft 115A pivots together with the linking lever 117B. A restricting pin 117E, which is provided on a side wall of the detection part 113, is slidably inserted into an elongated hole 215C formed in the shielding member 115 for restricting displacement of the shielding member 215. A coupling pin 215D is fixed to the shielding member 215. The coupling pin 215D is slidably inserted into an elongated hole 117F of the linkage 117.

Therefore, when the linking lever 117B pivots, the shielding member 215 reciprocates in the front-to-rear direction (left-to-right direction in FIG. 16), while the vertical displacement of the shielding member 215 is restricted by the restricting pin 117E and the elongated hole 215C.

Variations of the Embodiments

In these embodiments described above, the shielding members 115 and 215 is reciprocated in the front-to-rear direction of the image-forming device 1, but the present invention is not limited to this configuration. For example, the shielding members 115 and 215 may be reciprocated in the widthwise direction.

Further, while the "direction different from the vertical direction" is a horizontal direction in these embodiments described above, the present invention is not limited to this direction.

Further, while the shielding members 115 and 215 are reciprocated by a drive force obtained from the auger 116 in these embodiments described above, the present invention is not limited to this configuration.

Further, while the present invention is applied to a direct tandem laser printer in these embodiments described above, the present invention is not limited to this application. For example, the present invention may be applied to a monochrome electrophotographic image-forming device.

Further, while an exposure device is employed for scanning laser beams over the photosensitive drums 71 in these embodiments described above, the present invention is not limited to this configuration. For example, a plurality of LEDs may be arranged along the axial direction of the photosensitive drums 71, and the photosensitive drums 71 may be exposed by flashing the LEDs.

While the invention has been described in detail with reference to specific embodiments thereof, it would be apparent to those skilled in the art that many modifications and variations may be made therein without departing from the spirit of the invention, the scope of which is defined by the attached claims.

What is claimed is:

1. An image-forming device comprising:

an electroholographic image-forming section that transfers developer onto a recording sheet to form developer image thereon;

a receptacle that collects developer not transferred onto the recording sheet, the receptacle including a detection portion;

a detecting unit that detects light passing through the detection portion;

a shielding member that is movably disposed in the receptacle to move between a first position blocking the light to be detected by the detecting unit and a second position allowing the light to pass through the detection portion;

and a drive mechanism that moves the shielding member between the first position and the second position in a direction different from a vertical direction.

2. The image-forming device according to claim 1, wherein the drive mechanism reciprocates the shielding member periodically.

3. The image-forming device according to claim 1, wherein the drive mechanism moves the shielding member substantially horizontally.

4. The image-forming device according to claim 3, wherein the shielding member has a top end and is pivotally movable about a pivoting center set on the top end.

5. The image-forming device according to claim 4, further comprising a conveying mechanism that conveys developer into the detection portion and generates a motive force;

wherein the drive mechanism moves the shielding member according to the motive force of the conveying mechanism.

6. The image-forming device according to claim 5, wherein the detection portion comprises a sloped guiding portion that guides developer conveyed into the detection portion toward the light path.

7. The image-forming device according to claim 5, wherein the conveying mechanism comprises a rotational shaft and a spiral-shaped blade formed around the rotational shaft; and wherein the pivoting center set on the top end is offset from the rotational shaft.

8. The image-forming device according to claim 1, further comprising a conveying belt that conveys the recording sheet and has an outer surface; wherein the receptacle is disposed in a position opposing the outer surface of the conveying belt for collecting residual developer from the outer surface of the conveying belt.

9. The image-forming device according to claim 8, wherein the receptacle comprises a toner accumulating portion that collects the residual developer and a toner conveying mechanism that conveys the residual developer in the toner accumulating portion to the detecting portion.

10. The image-forming device according to claim 2, further comprising a determining unit that determines a state of accommodation of developer in the receptacle based on a detection result of the detecting unit.

11. The image-forming device according to claim 10, wherein the determining Unit determines that the receptacle is capable of further accumulating developer when the detecting unit periodically detects the light whereas the determining unit determines that the receptacle is incapable or further accumulating developer ashen the detecting unit fails to detect the light.

12. The image-forming device according to claim 10, further comprising a main body, wherein the receptacle is detachably mounted in the main body and the detecting unit is fixedly mounted to the main body.

13. The image-forming device according to claim 10, wherein the determining unit determines that the receptacle is not mounted in the main body when the detecting unit detects the light continuously.

* * * * *